US010036993B2

(12) United States Patent
Shigenaga

(10) Patent No.: US 10,036,993 B2
(45) Date of Patent: Jul. 31, 2018

(54) IMAGE FORMING APPARATUS AND FOREIGN MATTER REMOVING METHOD

(71) Applicant: Konica Minolta, Inc., Chiyoda-ku, Tokyo (JP)

(72) Inventor: Yasunori Shigenaga, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/422,042

(22) Filed: Feb. 1, 2017

(65) Prior Publication Data

US 2017/0227915 A1 Aug. 10, 2017

(30) Foreign Application Priority Data

Feb. 4, 2016 (JP) ..... 2016-019392

(51) Int. Cl.

*G03G 15/00* (2006.01)
*G03G 21/00* (2006.01)
*G03G 15/02* (2006.01)

(52) U.S. Cl.

CPC ..... *G03G 21/0023* (2013.01); *G03G 21/0029* (2013.01); *G03G 21/0076* (2013.01); *G03G 15/0266* (2013.01); *G03G 15/5037* (2013.01)

(58) Field of Classification Search

CPC ..... G03G 21/0023; G03G 21/0029; G03G 15/0266; G03G 15/5037; G03G 21/0076
See application file for complete search history.

(56) References Cited

U.S. PATENT DOCUMENTS 4,516,849 A * 5/1985 Tsutsui ..... G03G 21/0029 399/102
8,428,481 B2 * 4/2013 Thayer ..... G03G 21/0029 399/123
2009/0035036 A1 * 2/2009 Shirai ..... G03G 15/5037 399/345
2012/0148284 A1 * 6/2012 Rimai ..... G03G 21/0029 399/71
2014/0072325 A1 * 3/2014 Lee ..... G03G 15/161 399/101
2015/0192877 A1 * 7/2015 Fujioka ..... G03G 15/0189 399/43

FOREIGN PATENT DOCUMENTS

JP H07128957 A 5/1995
JP 2005010809 A 1/2005
JP 2007094283 A 4/2007

* cited by examiner

*Primary Examiner* — Francis Gray
(74) *Attorney, Agent, or Firm* — Cantor Colburn LLP

(57) ABSTRACT

An image forming apparatus includes a potential applier, a cleaning device and a hardware processor. The cleaning device includes an abutting member abutting a surface of the image carrier and removes residual toner on the surface of the image carrier by means of the abutting member after a toner image formed on the surface of the image carrier is transferred to a transfer material. In a cleaning mode for removing a foreign matter attached to the abutting member of the cleaning device, the hardware processor controls the potential applier to alternately apply a first potential and a second potential which is lower than the first potential to the image carrier so as to periodically change a potential of the abutting member without causing saturation.

19 Claims, 10 Drawing Sheets

FIG. 6

| HIGH POTENTIAL PERIOD (sec) t1 | LOW POTENTIAL PERIOD (sec) t2 | t1+t2 | NUMBER OF REPETITION IN 60 SECONDS | IMAGE SMEAR |
|---|---|---|---|---|
| 0. 5 | 0. 5 | 1. 0 | 60 | △ |
| 1. 0 | 0. 5 | 1. 5 | 40 | △ |
| 2. 0 | 0. 5 | 2. 5 | 24 | △ |
| 0. 5 | 1. 0 | 1. 5 | 40 | ○ |
| 1. 0 | 1. 0 | 2. 0 | 30 | ○ |
| 2. 0 | 1. 0 | 3. 0 | 20 | ○ |
| 0. 5 | 2. 0 | 2. 5 | 24 | ◎ |
| 1. 0 | 2. 0 | 3. 0 | 20 | ◎ |
| 2. 0 | 2. 0 | 4. 0 | 15 | ◎ |
| 3. 0 | 2. 0 | 5. 0 | 12 | ○ |
| 5. 0 | 2. 0 | 7. 0 | 8 | △ |
| 10. 0 | 2. 0 | 12. 0 | 5 | × |
| 15. 0 | 2. 0 | 17. 0 | 3 | × |

FIG.8

| BEADS CARRY OVER | EXAMPLE | COMPARISON 1 | COMPARISON 2 |
|---|---|---|---|
| HIGH POTENTIAL OF PHOTORECEPTOR (V) | -500 | -500 | -500 |
| LOW POTENTIAL OF PHOTORECEPTOR (V) | -100 | -100 | -100 |
| HIGH POTENTIAL PERIOD (sec) | 2. 5 | 0. 01 | 0. 01 |
| LOW POTENTIAL PERIOD (sec) | 2. 5 | 0. 01 | 0. 01 |
| DEVELOPING BIAS (V) | FOLLOW PHOTORECEPTOR POTENTIAL | -300 | -400 |
| FOG MARGIN (V) | -100 | -200 | -100 |
| NUMBER OF CARRIER ADHERED (pieces) | 2 | 40 | 2 |
| EVALUATION | ○ | × | ○ |

FIG.9

| TONER CONSUMPTION | EXAMPLE | COMPARISON 2 |
|---|---|---|
| HIGH POTENTIAL OF PHOTORECEPTOR (V) | -500 | -500 |
| LOW POTENTIAL OF PHOTORECEPTOR (V) | -100 | -100 |
| HIGH POTENTIAL PERIOD (sec) | 2. 5 | 0. 01 |
| LOW POTENTIAL PERIOD (sec) | 2. 5 | 0. 01 |
| DEVELOPING BIAS (V) | FOLLOW PHOTORECEPTOR POTENTIAL | -400 |
| DEVELOPMENT FIELD (V) | 0 or less | -300 |
| CONSUMPTION (g/min) | 0. 276 | 25 |
| EVALUATION | ○ | × |

FIG.10

| ABSOLUTE TEMPERATURE INSIDE APPARATUS: LESS THAN 10℃/20% | | | | |
|---|---|---|---|---|
| DURATION OF CLEANING MODE (min) | COVERAGE RATE OF ORIGINAL | | | |
| NUMBER OF PRINTING (sheets) | LESS THAN 3% | 3% TO LESS THAN 10% | 10% TO LESS THAN 30% | 30% OR MORE |
| 1000 | UNNECESSARY | UNNECESSARY | UNNECESSARY | UNNECESSARY |
| 5000 | UNNECESSARY | UNNECESSARY | UNNECESSARY | 1 |
| 10000 | 1 | 2 | 2 | 2 |
| 20000 | 1 | 2 | 2 | 3 |

FIG.11

| ABSOLUTE TEMPERATURE INSIDE APPARATUS: 10℃/20% TO LESS THAN 20℃/50% | | | | |
|---|---|---|---|---|
| DURATION OF CLEANING MODE (min) | COVERAGE RATE OF ORIGINAL | | | |
| NUMBER OF PRINTING (sheets) | LESS THAN 3% | 3% TO LESS THAN 10% | 10% TO LESS THAN 30% | 30% OR MORE |
| 1000 | UNNECESSARY | UNNECESSARY | UNNECESSARY | UNNECESSARY |
| 5000 | UNNECESSARY | UNNECESSARY | UNNECESSARY | UNNECESSARY |
| 10000 | UNNECESSARY | UNNECESSARY | UNNECESSARY | 1 |
| 20000 | UNNECESSARY | UNNECESSARY | 1 | 1 |

FIG.12

| ABSOLUTE TEMPERATURE INSIDE APPARATUS: 20℃/50% OR MORE | | | | |
|---|---|---|---|---|
| DURATION OF CLEANING MODE (min) | COVERAGE RATE OF ORIGINAL | | | |
| NUMBER OF PRINTING (sheets) | LESS THAN 3% | 3% TO LESS THAN 10% | 10% TO LESS THAN 30% | 30% OR MORE |
| 1000 | UNNECESSARY | UNNECESSARY | UNNECESSARY | UNNECESSARY |
| 5000 | UNNECESSARY | UNNECESSARY | UNNECESSARY | UNNECESSARY |
| 10000 | UNNECESSARY | UNNECESSARY | UNNECESSARY | UNNECESSARY |
| 20000 | UNNECESSARY | UNNECESSARY | UNNECESSARY | UNNECESSARY |

FIG.13

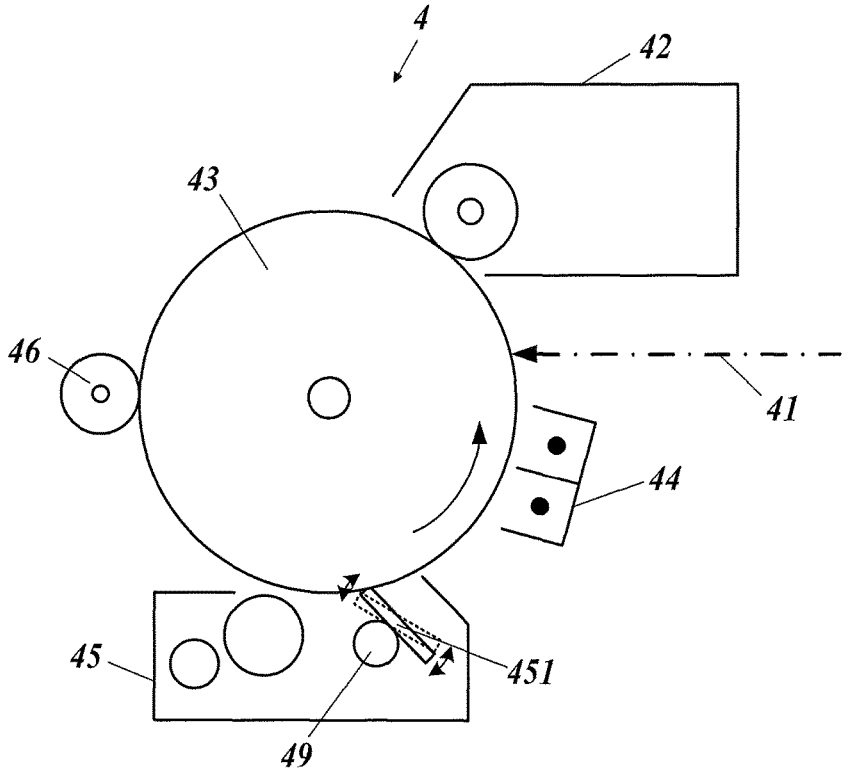

IMAGE FORMING APPARATUS AND FOREIGN MATTER REMOVING METHOD

CROSS REFERENCE TO RELATED APPLICATIONS

The present invention claims priority under 35 U.S.C. § 119 to Japanese Application No. 2016-019392 filed Feb. 4, 2016, the entire content of which is incorporated herein by reference.

BACKGROUND OF THE INVENTION

1. Field of the Invention

The present invention relates to an image forming apparatus and a foreign matter removing method.

2. Description of Related Art

In conventional image forming apparatuses, foreign matter such as toner that is attached on the surface of an image carrier such as an intermediate transfer belt or a photoreceptor drum is scraped and removed after image transfer by means of a blade (abutting member) of a cleaning device that abuts the image carrier.

However, when a large number of sheets of recording media is processed for example, the toner that has been accumulated at the abutment part between the blade and the image carrier may sometimes leak to the back face of the blade at the downstream side in the rotational direction of the image carrier, and the leaked toner may be gradually accumulated onto the back face of the blade. Then, when the toner on the back face of the blade transfers back to the image carrier, it causes an image defect.

To avoid this, it is possible to attach the toner and the like accumulated on the blade onto the surface of the image carrier by separating the developer from the image carrier and forming a potential pattern on the surface of the image carrier in which a first potential and a second potential lower than the first potential are alternately distributed in the rotational direction of the image carrier, and to collect them by means of a collector (e.g. the developer). The occurrence of image defect can thus be prevented (see JP 2007-094283A).

However, in typical image forming apparatuses that do not have a structure to separate a developer from an image carrier, the developing bias (potential between the image carrier and the developer) cannot be controlled to follow the potential pattern when the potential pattern of the alternating first and second potentials has a short cycle. Accordingly, it is required to employ a technique that is applicable in the condition that the developing bias is fixed at a certain level.

However, a problem with fixing the developing bias at a certain level is the increased fog margin (difference between the first potential of the image carrier and the potential of the developing bias). For example, when the fog margin is increased to "−150 V or more", a phenomenon of a carrier adhering to the image carrier, also known as beads carry over, occurs, which results in internal contamination of the image forming apparatus, damage of the image carrier and the like.

In contrast, when the fog margin (difference between the first potential of the image carrier and the potential of the developing bias) is maintained at a low level, for example in the range of approximately "−100 V to −150V", it is possible to prevent the occurrence of beads carry over. However, the potential difference between the second potential of the image carrier and the developing bias is increased compared to the former case. Since toner is transferred to the image carrier according to the significance of the potential difference, a problem with this case is an increased amount of toner consumed. Furthermore, another problem is that a large amount of toner transferred to the image carrier causes imperfect cleaning.

It is an object of the present invention to provide an image forming apparatus and a foreign matter removing method that can remove foreign matter such as toner attached to a blade without causing beads carry over or increasing the toner consumption.

SUMMARY OF THE INVENTION

In order to realize the above object, according to one aspect of the present invention, there is provided an image forming apparatus, including:

a potential applier which applies a potential to an image carrier;

a cleaning device which comprises an abutting member abutting a surface of the image carrier and which removes residual toner on the surface of the image carrier by means of the abutting member after a toner image formed on the surface of the image carrier is transferred to a transfer material;

a hardware processor which, in a cleaning mode for removing a foreign matter attached to the abutting member of the cleaning device, controls the potential applier to alternately apply a first potential and a second potential which is lower than the first potential to the image carrier so as to periodically change a potential of the abutting member without causing saturation.

Preferably, the image forming apparatus further includes:

a measuring device which measures a potential of the image carrier and the potential of the abutting member, wherein the hardware processor changes at least one of the first potential and the second potential of the image carrier based on a difference between the potential of the image carrier and the potential of the abutting member measured by the measuring device.

Preferably, the image forming apparatus further includes:

a charger which charges the image carrier;

an exposure device which exposes the image carrier to form an electrostatic latent image;

a developer which develops the electrostatic latent image by attaching toner onto the surface of the image carrier so as to form a toner image; and a transfer device which transfers the toner image on the surface of the image carrier to the transfer material, wherein the potential applier is constituted by one of the charger, the exposure device and the transfer device or any combination thereof.

Preferably, the image forming apparatus further includes:

an adjuster which adjusts a pressing force of the abutting member, wherein in the cleaning mode, the hardware processor controls the adjuster to reduce the pressing force of the abutting member against the image carrier to a lower level than the pressing force in a printing mode for forming an image.

Preferably, in the cleaning mode, the hardware processor rotates the image carrier in a reverse direction so as to transfer the foreign matter from the abutting member to the image carrier, and then rotates the image carrier in a forward direction so as to remove the foreign matter by means of the cleaning device.

Preferably, the hardware processor determines necessity of performing the cleaning mode based on any one of a coverage rate of an original, the number of printing and absolute humidity or any combination thereof.

Preferably, the hardware processor determines a duration of performing the cleaning mode based on any one of the coverage rate of the original, the number of printing and the absolute humidity or any combination thereof.

Preferably, the image forming apparatus further includes:

a detector which detects the foreign matter on the surface of the image carrier, wherein the hardware processor determines necessity of performing the cleaning mode based on a detection result by the detector.

Preferably, the image forming apparatus further includes:

a detector which detects the foreign matter on the surface of the image carrier, wherein the hardware processor terminates the cleaning mode based on a detection result by the detector.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein:

FIG. 6 is an explanatory view illustrating the relationship between high and low potential periods and image smear;

FIG. 8 is an explanatory view illustrating the relationship of beads carry over between Example and Comparisons;

FIG. 9 is an explanatory view illustrating the relationship of toner consumption between Example and Comparison;

FIG. 10 is an explanatory view illustrating the relationship of duration of a cleaning mode to coverage rate of an original, absolute humidity and the number of printing;

FIG. 11 is another explanatory view illustrating the relationship of duration of cleaning mode to coverage rate of an original, absolute humidity and the number of printing;

FIG. 12 is another explanatory view illustrating the relationship of duration of cleaning mode to coverage rate of an original, absolute humidity and the number of printing;

FIG. 13 is an explanatory view of an example of a driver that drives an abutting member according to a variation.

DETAILED DESCRIPTION OF THE PREFERRED EMBODIMENTS

Embodiment

1. Description of Configuration

Hereinafter, a specific embodiment of the present invention will be described with drawings. However, the scope of the present invention is not limited to the illustrated examples.

Figure 1:
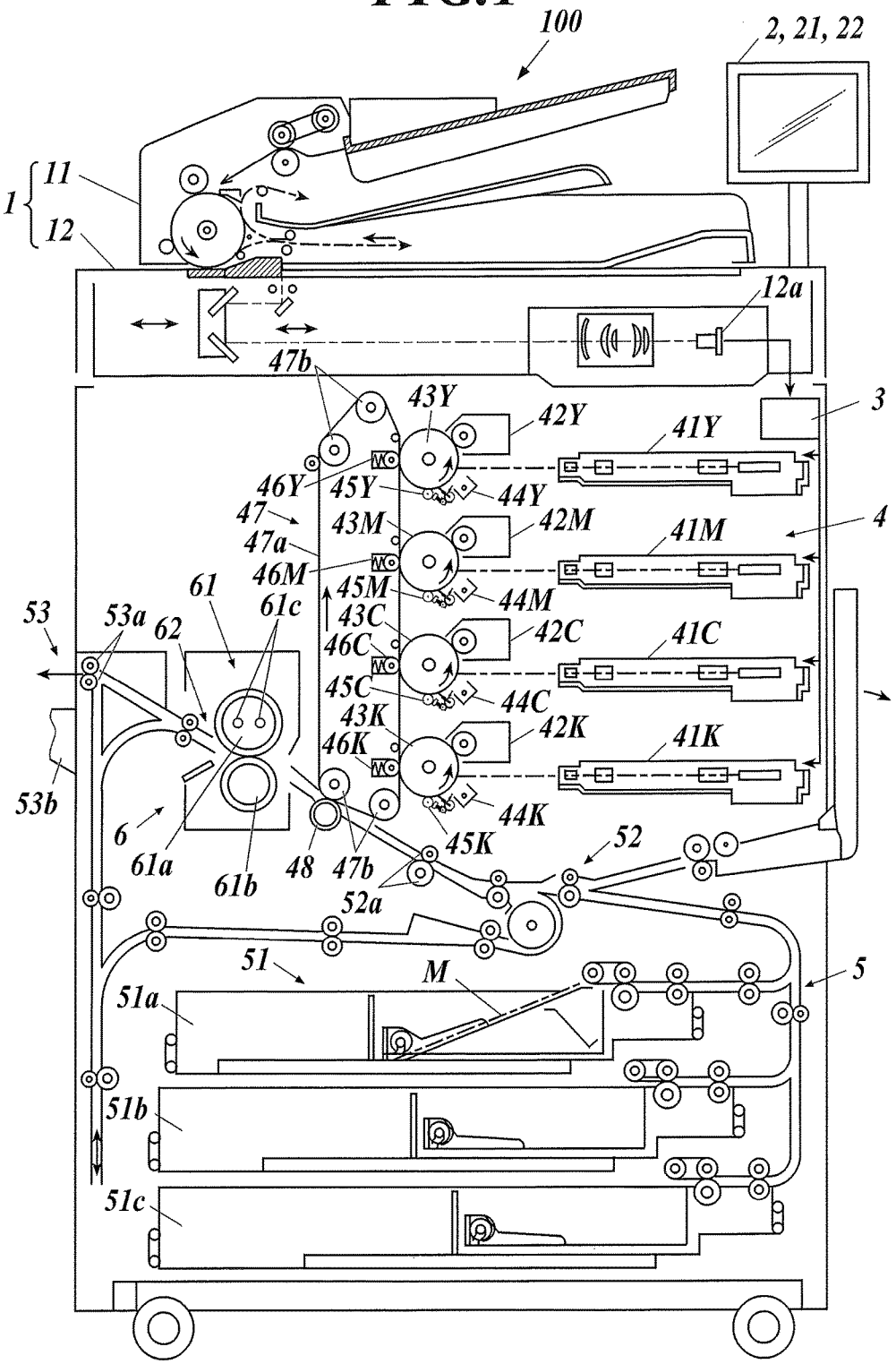
FIG. 1 illustrates the schematic configuration of an image forming apparatus according to an embodiment of the present invention.
Figure 2:
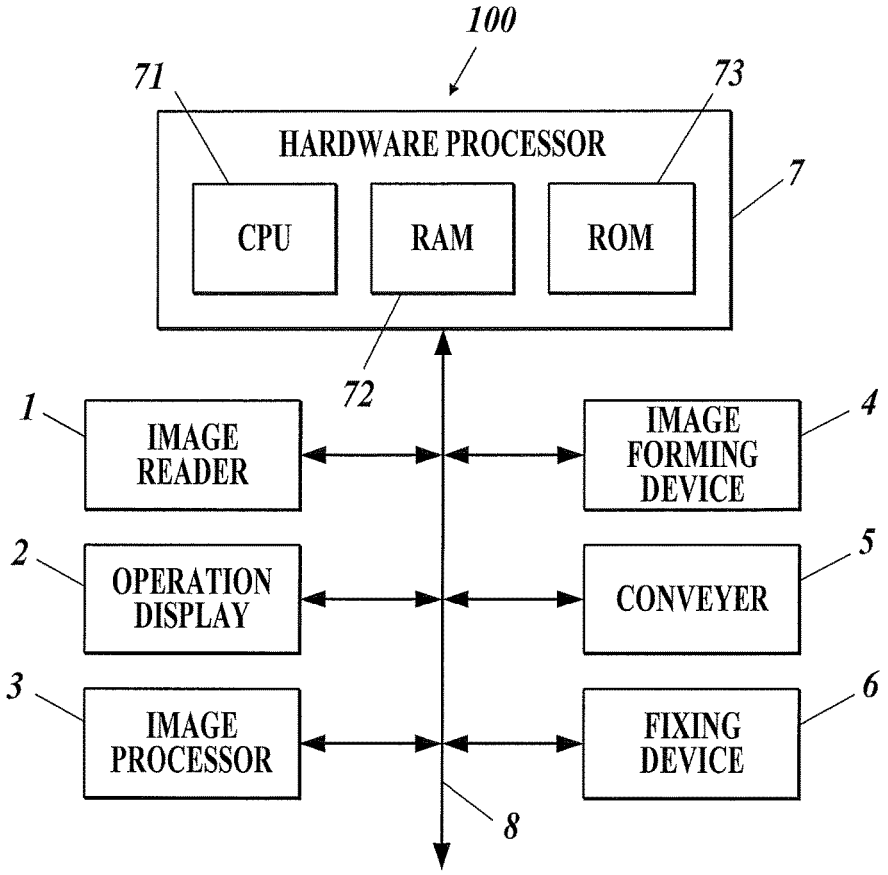
FIG. 2 is a block diagram of the image forming apparatus, illustrating the main functional configuration thereof.

FIG. 1 illustrates the schematic configuration of an image forming apparatus 100 according to an embodiment of the present invention. FIG. 2 is a block diagram of the image forming apparatus, illustrating the main functional configuration thereof.

As illustrated in FIG. 1, the image forming apparatus 100 of the embodiment forms an image by overlaying colors on a sheet (recording medium) M based on an image data that is obtained by reading a color image on an original or an image data that is input from external information equipment (e.g. personal computer) through a network.

The image forming apparatus 100 is a tandem image forming apparatus in which photoreceptor drums 43Y, 43M, 43C and 43K corresponding to four colors of yellow (Y), magenta (M), cyan (C) and black (K), respectively, are disposed in series in the running direction of an intermediate transfer belt 47*a*, and the respective color toner images are sequentially transferred to a transfer body in a single process.

Specifically, as shown in FIG. 2, the image forming apparatus 100 of this embodiment includes an image reader 1, an operation display 2, an image processor 3, an image forming section 4, a conveyer 5, a fixing device 6, a controller 7 and the like.

Further, the hardware processor 7 is connected to the image reader 1, the operation display 2, the image processor 3, the image forming device 4 and the conveyer 5 and the fixing device 6 through a bus 8.

The image reader 1 includes an automatic document feeder 11 (also referred to as an ADF), a document image scanner 12 and the like.

The automatic document feeder 11 conveys an original mounted on a document tray to the document image scanner 12 by means of a conveyance mechanism. The automatic document feeder 11 enables images on (both sides of) a number of sheets of original mounted on the document tray to be read successively.

The document image scanner 12 reads the original image by optically scanning either the original conveyed from the automatic document feeder 11 onto a contact glass or the original manually mounted on the contact glass and focusing the reflecting light from the original on a light receiving surface of a CCD (charge coupled device) sensor 12*a*. The image (analog image signal) read by the image reader 1 is subjected to a predetermined image processing in the image processor 3.

As used herein, the term "image" includes not only image data such as figures and photographs but also text data such as characters and symbols.

The operation display 2, which is constituted by a liquid crystal display (LCD) with a touch panel, or the like, serves as a display 21 and an operation section 22.

The display 21 displays various operation windows, image conditions, the operation status of various functions and the like according to a display control signal input from the controller 7.

The operation section 22, which includes various operation keys such as numeric keys and a start key, receives inputs from various user operations and outputs an operation signal to the controller 7.

The image processor 3 includes a circuit for analog-digital (A/D) conversion, a circuit for digital image processing and the like.

The image processor 3 performs A/D conversion on the analog image signal from the image reader 1 so as to generate a digital image data (RGB signal). The image processor 3 further performs color conversion, gradation reproduction (e.g. screening), corrections (e.g. shading) according to a default setting or a user setting, compression and the like on the digital image data. Based on the digital image data (YMCK signal) on which this processing is performed, the image forming section 4 is controlled.

The image forming section 4 includes exposure devices 41Y, 41M, 41C and 41K, developers 42Y, 42M, 42C and 42K, photoreceptor drums 43Y, 43M, 43C and 43K that serves as image carriers, chargers 44Y, 44M, 44C and 44K, cleaning devices 45Y, 45M, 45C and 45K and primary transfer rollers 46Y, 46M, 46C and 46K, which are provided corresponding to the respective color components Y, M, C and K. The image forming section 4 also includes an intermediate transfer unit 47 and the like.

In a unit for the Y component of the image forming section 4, the charger 44Y charges the photoreceptor drum 43Y. The exposure device 41Y, which is constituted by a semiconductor laser for example, irradiates the photoreceptor drum 43Y with a laser beam corresponding to the Y component. As a result, an electrostatic latent image of the Y component is formed on the surface of the photoreceptor drum 43Y. The developer 42Y stores a developing agent for the Y component (e.g. two-component developing agent composed of micro toner particles and a magnetic material). The developer 42Y develops the electrostatic latent image (forms a toner image) by making the Y component toner adhere to the surface of the photoreceptor drum 43Y.

Similarly, units for the M, C and K components form the respective color toner images on the surfaces of the photoreceptor drums 43M, 43C and 43K.

The cleaning devices 45Y, 45M, 45C and 45K remove the residual toner and foreign objects on the surface of the photoreceptor drums 43Y, 43M, 43C and 43K by means of a blade or the like which serves as an abutting member that abuts the surface of the photoreceptor drums 43Y, 43M, 43C and 43K.

The intermediate transfer unit 47 is configured such that an endless intermediate transfer belt 47*a*, which serves as a transfer body, is stretched and supported by support rollers 47*b*.

The intermediate transfer belt 47*a* is brought into pressure contact with the photoreceptor drums 43Y, 43M, 43C and 43K by means of the primary transfer rollers 46Y, 46M, 46C and 46K so that the respective color toner images are sequentially overlaid on the intermediate transfer belt 47*a*. The primary transfer is thus completed. Then, the intermediate transfer belt 47*a* on which the toner image has been primarily transferred is brought into contact with the sheet M by means of a secondary transfer roller 48 so that the toner image is secondarily transferred to the sheet M.

The conveyer 5 includes a sheet feeder 51, a conveyance mechanism 52, a sheet ejector 53 and the like.

The sheet feeder 51 includes three sheet feeding tray units 51*a* to 51*c*. The sheet feeding tray units 51*a* to 51*c* store the sheets M according to the preset sheet types, which are standard papers and special sheets classified by basis weight and size. The sheets M stored in the sheet feeding tray units 51*a* to 51*c* are discharged one by one from the uppermost sheet and are conveyed to the image forming section 4 by means of the conveyance mechanism 52 that includes conveyance rollers such as resist rollers 52*a*. During conveyance, a resist portion, in which the resist rollers 52*a* are disposed, corrects the inclination of the fed sheet M and also adjusts the conveyance timing.

Then, the toner image on the intermediate transfer belt 47*a* is secondarily transferred to an image forming face of the sheet M in the image forming section 4, and the transferred image is subjected to a fixing step in the fixing device 6. The sheet M on which the image has been formed is ejected to an outside sheet eject tray 53*b* by means of a sheet ejector 53 including sheet eject rollers 53*a*.

The fixing device 6 includes a fixing roller 61*a*, a press roller 61*b* and the like. The fixing device 6 performs the fixing step for fixing the toner image transferred on the sheet M. The fixing roller 61*a* and the press roller 61*b* constitute a nip portion that nips and conveys the sheet M.

The fixing roller 61*a* is disposed on the image forming side of the sheet M. The fixing roller 61*a* is rotated by a driving means (not shown) such as a motor.

For example, the fixing roller 61*a* is configured such that an elastic layer made of silicone rubber or the like is formed on the outer circumferential face of a cylindrical core metal made of iron or the like. The fixing roller 61*a*, which is equipped with a fixing heater 61*c* such as a halogen heater, comes in contact with the image forming face of the sheet M on which the toner image has been transferred so as to heat the sheet M at a predetermined fixing temperature. That is, while the fixing roller 61*a* is rotating, it comes in contact with the image forming face of the sheet M so as to heat the sheet M.

The predetermined fixing temperature refers to a temperature at which a sufficient amount of heat can be applied for melting the toner while the sheet M is passing through the nip portion, which differs depending on the type of the sheet M on which an image is formed.

The press roller 61*b* is disposed opposite the fixing roller 61*a* and is pressed against the fixing roller 61*a* at a predetermined pressing force. That is, the press roller 61*b* together with the fixing roller 61*a* serves as a pressing portion that nips and presses the sheet M.

For example, the press roller 61*b* is configured such that an elastic layer made of silicone rubber or the like is formed on the outer circumferential face of a cylindrical core metal made of iron or the like. Further, the surface of the press roller 61*b* is hard relative to the surface of the fixing roller 61*a*. With this configuration, the press roller 61*b* that is pressed against the fixing roller 61*a* digs into the surface elastic layer of the fixing roller 61*a* in the nip portion.

The processor 7 includes CPU (Central Processing Unit) 71, RAM (Random Access Memory) 72 and ROM (Read Only Memory) 73 and integrally controls the components of the image forming apparatus 1 according to control programs. For example, the processor 7 controls the image processor 3 to perform predetermined image processing on image data. Further, the processor 7 controls the conveyance device 5 to convey a sheet and also controls the image forming device 4 to form an image on the sheet, which is a recording medium, based on the image data.

The CPU 71 reads out a control program stored in the ROM 73 or the like and executes it to perform a variety of processing.

The RAM 72 provides a working memory space to the CPU 71 and stores temporary data.

The ROM 73 stores a variety of control programs to be executed by the CPU 71, setting data and the like. In replace of the ROM 73, a rewritable non-volatile memory such as an EEPROM (electrically erasable programmable read only memory) or a flash memory may be used.

2. Description of Operation of Image Forming Apparatus

Figure 3:
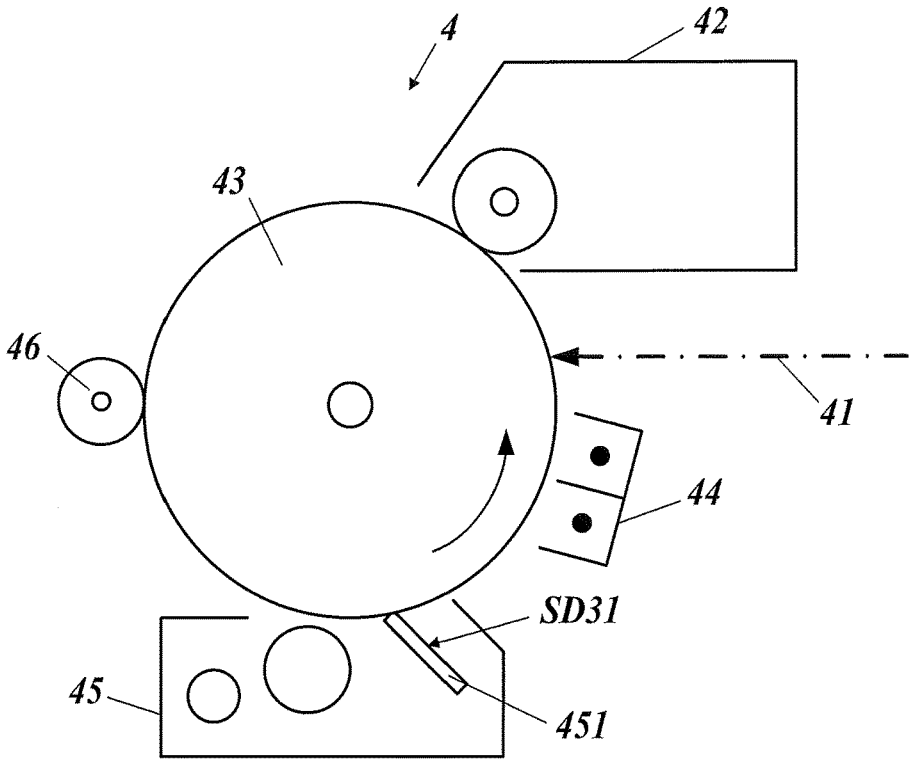
FIG. 3 is an explanatory enlarged view of an area around an example of an image carrier.

Hereinafter, the operation of the image forming apparatus for removing foreign matter such as toner on the blade will be described referring to FIG. 3 to FIG. 12. FIG. 3 is an enlarged explanatory view of an area around the photoreceptor drum 43 that serves as an image carrier.

As illustrated in FIG. 3, the cleaning device 45 includes a blade 451 that serves as an abutting member that abuts the photoreceptor drum 43 to remove residual toner and foreign matter on the surface of photoreceptor drum 43, and the like.

When a large number of sheets of recording media is processed, toner sometimes adhere to the blade 451 gradually from the abutment part to the face SD31 on the downstream side with respect to the rotational direction of the image carrier. Toner is typically negatively charged, but the toner that is attached on the face SD31 of the blade 451 is positively charged.

Figure 4:
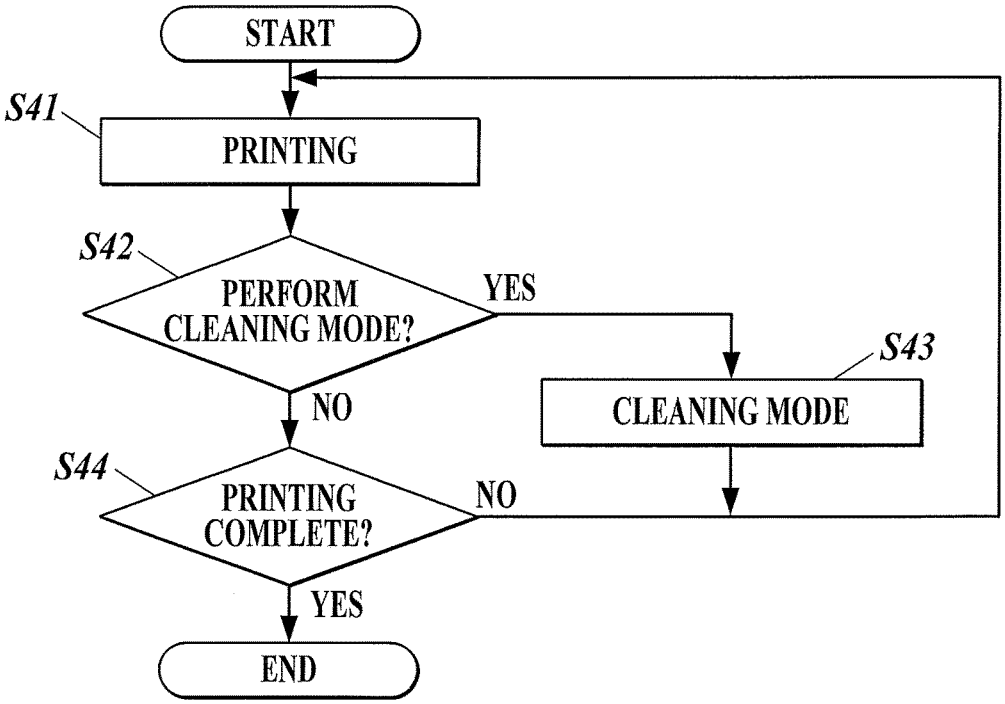
FIG. 4 is a flowchart of an example of the operation of the image forming apparatus.

As illustrated in FIG. 4, the hardware processor 7 performs normal printing (Step S41) and then makes a determination at predetermined timing as to whether to perform a cleaning mode for removing foreign matter such as toner on the blade 451 (Step S42). If the hardware processor 7 determines to perform the cleaning mode (Step S42, Yes), it performs the cleaning mode as described later (Step S43), and the process returns to Step S41.

If the hardware processor 7 determines not to perform the cleaning mode (Step S42, No), it further makes a determination as to whether to terminate the printing (Step S44). If the hardware processor 7 determines to terminate the printing (Step S44, Yes), the printing ends. If the hardware processor 7 determines not to terminate the printing, (Step S44, No), the process returns to Step S41.

Figure 5:
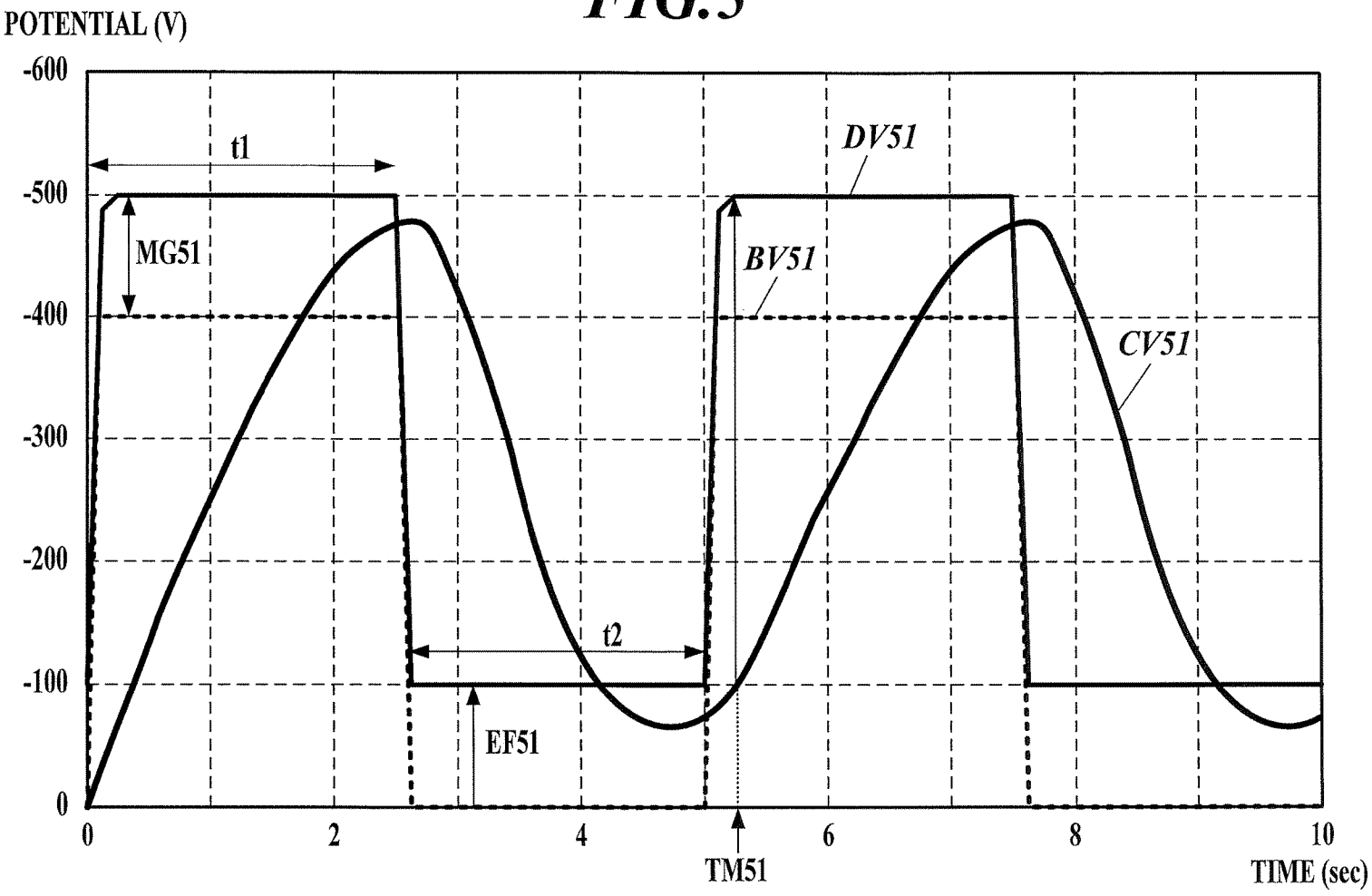
FIG. 5 is an explanatory view illustrating the change of the potential and the like of Example of the image carrier over time.

Then, when the hardware processor 7 performs the cleaning mode, it controls a potential applying device such as the charger 44 to apply a potential to the photoreceptor drum 43 so as to change the potential DV51 of the photoreceptor drum 43 between "−500 V (high potential)" and "−100V (low potential)" over time as illustrated in FIG. 5.

As illustrated in FIG. 5, the high potential period t1 and the low potential period t2 are both "2.5 sec". In such changing frequency, the hardware processor 7 can control the developing bias BV51 (potential between the image carrier and the developer) such that it follows the change of the potential of the photoreceptor drum 43. Accordingly, it is possible to set the fog margin MG 51 (potential difference between the high potential of the photoreceptor drum 43 and the developing bias) to "−100V".

As illustrated in FIG. 5, when the high potential period t1 and the low potential period t2 are both "2.5 sec", the potential CV51 of the blade 451 follows the potential DV51 of the photoreceptor drum 43 with a delay. Accordingly, the potential of the blade 451 makes a gentle curve unlike the rectangular curve of the potential DV51 of the photoreceptor drum 43.

Further, as illustrated in FIG. 5, the potential CV51 of the blade 451 does not become flat (constant) in the high potential period t1. Further, in the low potential period t2, the potential CV51 of the blade 451 reaches a potential of "−100 V" or less (approximately −60 V) and does not become flat. The potential CV51 thus changes in a gentle curve.

As used herein, the potential becoming flat in the high potential period t1 or the potential decreasing and becoming flat at a potential of "−100 V" or less in the low potential period t2 is defined as "saturation".

That is, in the cleaning mode, the potential of the photoreceptor drum 43 with respect to the blade 451 reaches approximately "−400 V" at the time TM51 in FIG. 5 for example, and the toner on the face SD31 of the blade 451, which is positively charged, is therefore transferred to the photoreceptor drum 43 and removed.

FIG. 6 is an explanatory view illustrating the occurrence of image smear with different high potential periods t1 and low potential periods t2.

The evaluation in FIG. 6 was made according to the following procedure.

1. Printing was performed on 10000 A4 sheets at a coverage rate of 40%.
2. A blank A3 sheet was passed through the apparatus (to check image smear).
3. A cleaning mode was performed.
4. A blank A3 sheet was passed through the apparatus (to check image smear, i.e. to check the efficacy of the cleaning mode).

In the column "image smear" in FIG. 6, "◎" represents that no image smear was observed, "○" represents that image smear was recognizable only in a detailed check, "Δ" represents that image smear was obvious at a glance, and "x" represents heavy image smear.

As illustrated in FIG. 6, when the low potential period t2 is fixed at "2.0 sec" while the high potential period t1 is changed between "0.5 to 2.0 sec", no image smear was observed. Further, when t1+t2 falls within the range of "1.5 to 5.0 sec", almost no image smear was observed. In contrast, significant image smear was observed in the other conditions. That is, it was found that image smear occurs when the high potential period t1 and the low potential period t2 are too long or too short.

Accordingly, it was found that toner can be effectively removed from the blade 451 when the low potential period t2, in which the potential CV51 of the blade 451 falls (toward a potential of −100 V or less), is set to approximately "2.0 sec" and the high potential period t1, in which the potential CV51 of the blade 451 rises, is set to "0.5 to 2.0 sec".

As illustrated in FIG. 5, the high potential period t1 and the low potential period t2 are both "2.5 sec". In such changing frequency, the hardware processor 7 can control the developing bias BV51 (potential between the image carrier and the developer) such that it follows the change of the potential of the photoreceptor drum 43. Accordingly, it is possible to set the fog margin MG 51 (potential difference between the high potential of the photoreceptor drum 43 and the developing bias) to "−100V".

Figure 7:
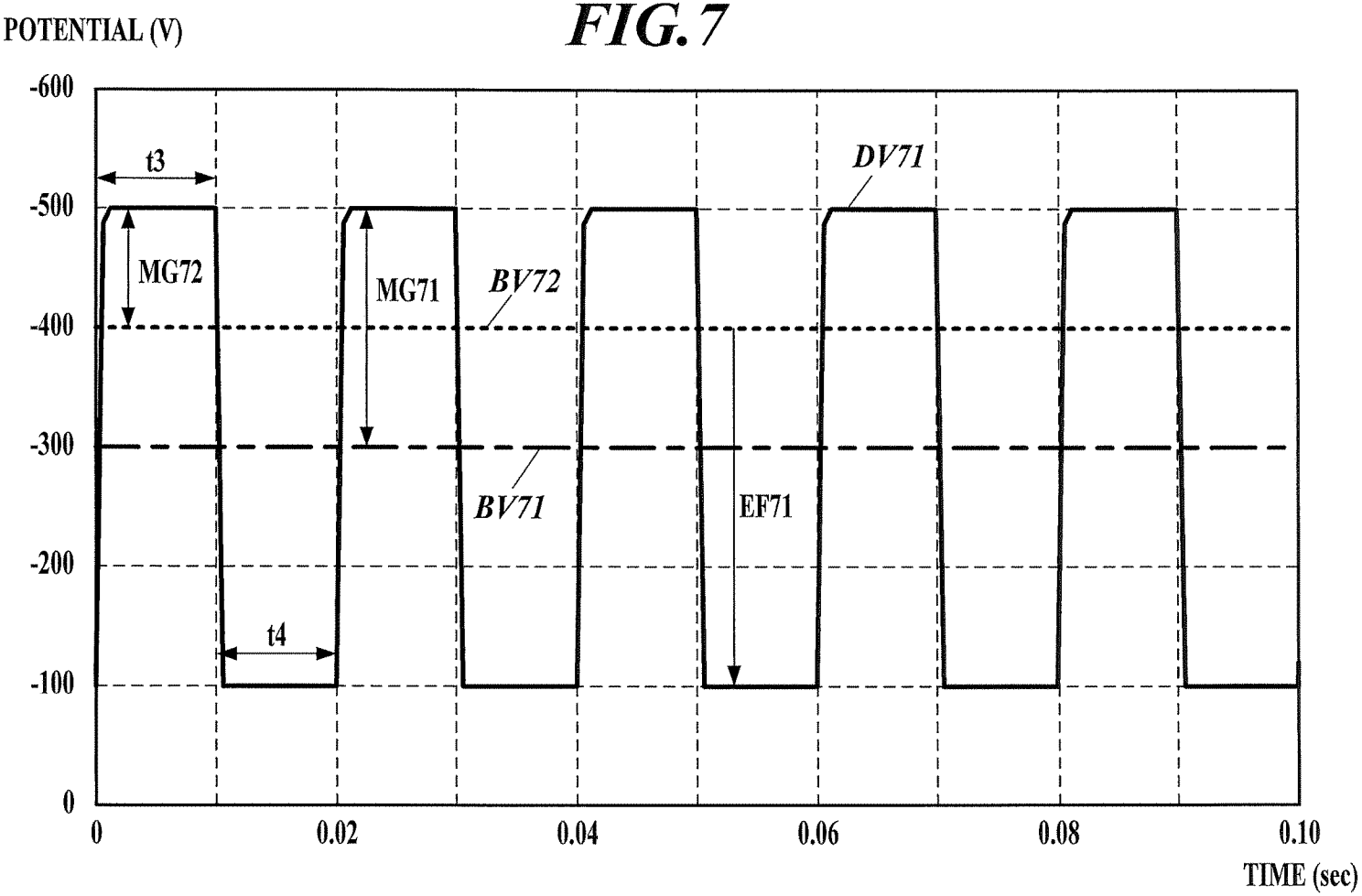
FIG. 7 is an explanatory view illustrating the change of the potential of an image carrier and the like of Comparison over time.

FIG. 7 is an explanatory view illustrating the change of the potential and the like of the image carrier of Comparison 1 and Comparison 2 over time. As illustrated in FIG. 7, in the comparisons, a high potential period t3 and a low potential period t4 of the potential DV71 of a photoreceptor drum 43 are both "0.01 sec". In this case, since a hardware processor 7 cannot control the developing bias such that it follows the change of the potential of the photoreceptor drum 43, the developing bias BV71 of Comparison 1 and the developing bias BV72 of Comparison 2 are both fixed at a certain level as illustrated in FIG. 7.

As illustrated in FIG. 7, when the developing bias BV71 is fixed at "−300 V" as in Comparison 1, the fog margin MG71 becomes "−200 V". When the developing bias BV72 is fixed at "−400 V" as in Comparison 2, the fog margin MG72 becomes "−100 V".

The beads carry over in these conditions was evaluated. As illustrated in FIG. 8, the number of carriers attached was "2" in Example and Comparison 2. This was because the fog margin was "−100 V" and beads carry over was less likely to occur. In contrast, the number of carriers attached was "40" in Comparison 1. This was because the fog margin was "−200 V (−150 V or more)" and beads carry over occurred. Such beads carry over causes contamination in the image forming apparatus, damage of the image carrier and the like, and Comparison 1 is therefore evaluated as "x".

The toner consumption changes according to the potential (development field) of the photoreceptor drum 43 with respect to the developer 42 in the low potential period t2 of the photoreceptor drum 43.

For example, in Example, the potential EF51 (development field) of the photoreceptor drum 43 with respect to the developer 42 is "−100 V" in the low potential period t2 of the photoreceptor drum 43 as illustrated in FIG. 5. Accordingly, the toner, which is normally negatively charged, does not transfer to the photoreceptor drum 43.

In contrast, in Comparison 2, the potential EF71 (development field) of the photoreceptor drum 43 with respect to the developer 42 is "+300 V" in the low potential period t4 of the photoreceptor drum 43 as illustrated in FIG. 7. Accordingly, the toner, which is normally negatively charged, transfers to the photoreceptor drum 43, and the toner is consumed continuously during the low potential period t2.

The toner consumption in these conditions was evaluated. As illustrated in FIG. 9, the toner consumption was "0.276 g/min" in Example. This was because the development field was "−100 V", and the toner was less likely to transfer to the photoreceptor drum 43. In contrast, the toner consumption was "25.000 g/min" in Comparison 2. This was because the development field was "+300 V", and the toner easily transferred to the photoreceptor drum 43. That is, the toner consumption of Comparison 2 is 100 times as high as that of Example, and Comparison 2 is therefore evaluated as "x".

As described above, it is possible to reduce the beads carry over and the toner consumption by alternating the potential DV51 of the photoreceptor drum 43 between "−500 V (high potential)" and "−100 V (low potential)" at the timing of the high potential period t1 and the low potential period t2 being both approximately "2.5 sec" and controlling the developing bias BV51 such that it follows the change of the potential DV51 of the photoreceptor drum 43.

FIG. 10 to FIG. 12 are explanatory views illustrating the duration of the cleaning mode that is required for eliminating the occurrence of image smear in a variety of conditions of the coverage rate of an original, the absolute humidity inside the apparatus and the number of printing.

As can be seen from FIG. 10 to FIG. 12, when the coverage rate of an original is high, the blade 451 is more contaminated compared to a case with low coverage rate of an original, and the duration of the cleaning mode tends to be long. Similarly, as the number of printing is larger, the duration of the cleaning mode tends to be longer.

As can also be seen from FIG. 10 to FIG. 12, when the absolute humidity inside the apparatus is high, it is not required to perform the cleaning mode regardless of the coverage rate of an original and the number of printing. This is because the blade 451 itself is less likely to be charged, and the toner is less likely to adhere to the blade 451 accordingly.

That is, the hardware processor 7 can determine the necessity and the duration of the cleaning mode based on the conditions given in FIG. 10 to FIG. 12.

As described above, the image forming apparatus 100 of the embodiment includes the charger 44 that charges the photoreceptor drum 43, the exposure device 41 that exposes the photoreceptor drum 43 to form an electrostatic latent image, a developer 42 that attaches toner onto the surface of the photoreceptor drum 43 to develop the electrostatic latent image, the transfer device 46 that transfers the toner on the surface of the photoreceptor drum 43, a cleaning device 45 that removes residual toner on the surface of the photoreceptor drum 43, and a hardware processor that periodically changes the potential of the blade 451 of the cleaning device 45 when performing the cleaning mode for removing foreign matter on a abutting member. This configuration enables removing foreign matter such as toner on the blade without causing beads carry over or increasing the toner consumption.

Variation

In the description of the embodiment, when performing the cleaning mode, the hardware processor 7 controls a potential applying device such as the charger 44 to apply a potential to the photoreceptor drum 43 so as to change the potential DV51 of the photoreceptor drum 43 between "−500 V (high potential)" and "−100 V (low potential)" over time, and thereby changes the potential CV51 of the blade 451 periodically. Instead, the hardware processor 7 may control the abutment or separation of the blade 451, which serves as the abutting member, and thereby change the potential CV51 of the blade 451 periodically.

For example, as illustrated in FIG. 13, the image forming apparatus 100 may include a driver 49 such as a motor or an actuator that rotatably drives the blade 451, and the hardware processor 7 controls the driver 49 to rotate the blade 451 so as to alternately switch the state of blade 451 between abutment and separation with respect to the photoreceptor drum 43. It is thus possible to change the potential CV51 of the blade 451 periodically.

That is, when the blade 451 is in contact with the photoreceptor drum 43, the potential CV51 of the blade 451 is gradually increased to the potential of the photoreceptor drum 43. When the blade 451 is separated from the photoreceptor drum 43, the potential CV51 of the blade 451 is gradually decreased. The potential CV51 of the blade 451 is thus changed periodically.

As described above, the image forming apparatus 100 includes a driver 47 that drives the blade 451, and the hardware processor 7 controls the driver 47 to alternately switch the state of the blade 451 between abutment and separation with respect to the photoreceptor drum 43 so as to periodically change the potential of the blade 451. This configuration enables removing foreign matter such as toner on the blade 451 without causing beads carry over or increasing the toner consumption.

In the description of the embodiment, it is assumed that the contaminant that adheres to the blade 451 and causes an image smear is basically toner, and such toner is removed. However, the object to be removed is not limited to toner.

For example, foreign matter such as paper dust (fiber scraped from paper by a roller), additives (substances that are added for stabilizing the physical properties of paper) and the like can be also electrically charged and can therefore adhere to the blade 451 as contaminant. Then, when such foreign matter adheres to the photoreceptor drum 43, they may cause imperfect charging, imperfect exposure or the like that leads to an image defect. With the present invention, it is possible to remove such foreign matter on the blade 451 in addition to toner and thus to prevent the occurrence of an image defect.

In the description of the embodiment, when performing the cleaning mode, the hardware processor 7 controls the potential applying device such as the charger 44 to apply a potential to the photoreceptor drum 43 so as to change the potential DV51 of the photoreceptor drum 43 between "−500 V (high potential)" and "−100 V (low potential)" over time. Instead, the image forming apparatus 100 may further include a measuring device that measures the potential DV51 of the photoreceptor drum 43 and the potential CV51 of the blade 451, and the hardware processor 7 may switch the potential of the photoreceptor drum 43 between the high potential and the low potential based on the difference between the potential DV51 of the photoreceptor drum 43 and the potential CV51 of the blade 451 measured by the measuring device.

For example, the hardware processor 7 measures the potential DV51 and the potential CV51 as in FIG. 5. When the potential CV51 is increased so that the difference is decreased to less than a predetermined threshold, the hardware processor 7 changes the potential DV51 to the low potential. When the potential CV51 is decreased so that the difference is increased to greater than a predetermined threshold, i.e. the potential CV51 is decreased approximately to a level of −100 V or less, the hardware processor 7 changes the potential DV51 to the high potential. This configuration enables removing the toner on the blade more efficiently compared to the case in which the potential DV51 is switched between the high potential and the low potential simply in every 2.5 sec.

In the description of the embodiment, the image forming apparatus 100 includes the single blade 451. However, it may include two or more blades and a driver that drives the blades 451, so that the blades are switchable by changing the position thereof.

Figure 14:
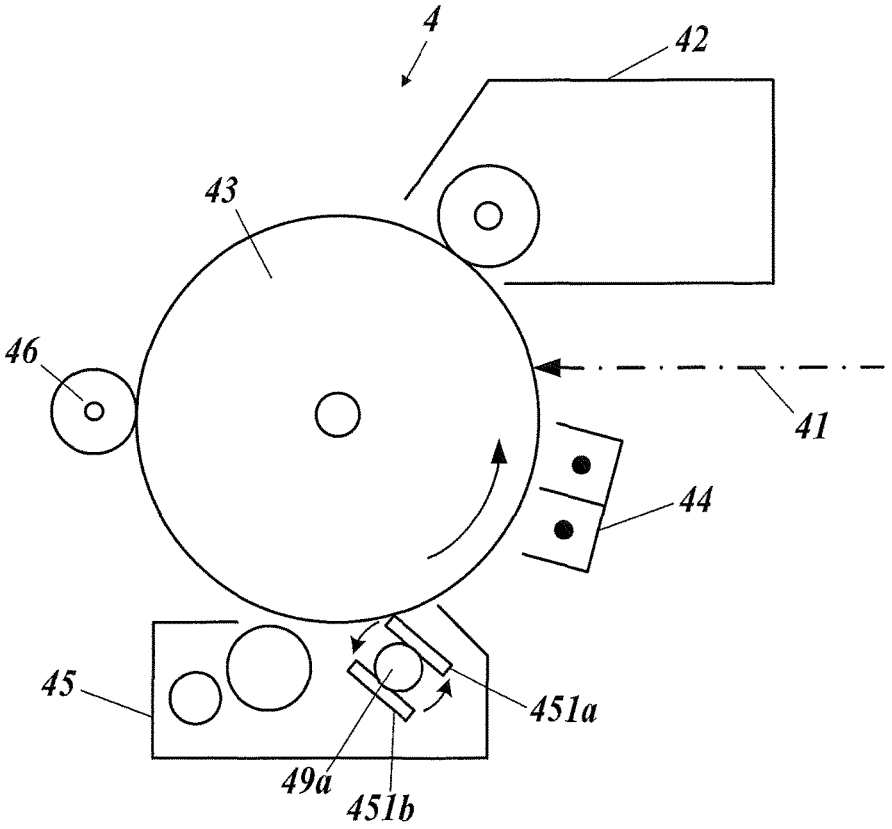
FIG. 14 is an explanatory view of an example of a driver that replaces an abutting member.

For example, as illustrated in FIG. 14, the image forming apparatus 100 may include a driver 49*a* such as a motor or an actuator that rotatably moves two blades 451*a*, 451*b*, and the hardware processor 7 may control the driver 49*a* to rotate the blades 451*a*, 451*b* so that the blade 451*a* can be switched to the blade 451*b*.

In the description of the embodiment, the pressing force of the blade 451 is constant. However, the image forming apparatus 100 may further include an adjuster that adjusts the pressing force of the blade 451. When performing the cleaning mode, the hardware processor 7 may control the adjuster to reduce the pressing force of the blade 451 against the photoreceptor drum 43 to less than the level in a printing mode in which an image is formed.

In this case, reducing the pressing force of the blade 451 against the photoreceptor drum 43 during the cleaning mode increases the delay of the potential CV51 of the blade 451 that follows the potential of the photoreceptor drum 43. This can extend the period such as the time point TM51 in FIG. 5 in which the potential difference of the photoreceptor drum 43 with respect to the blade 451 is large. Therefore, it is possible remove the toner on the blade more efficiently.

In the description of the embodiment, the photoreceptor drum 43 rotates in a single direction. However, when performing the cleaning mode, the hardware processor 7 may reverse the rotation of the photoreceptor drum 43 so as to transfer the foreign matter such as residual toner from the blade 451 to the photoreceptor drum 43, and then rotate the photoreceptor drum 43 in the forward direction so as to remove the foreign matter such as residual toner by means of the cleaning device 45.

In this case, the foreign matter such as residual toner that has been transferred to the photoreceptor drum 43 does not travel around the photoreceptor drum 43. This can prevent contamination of components at the downstream such as the charger 44 by the foreign matter such as residual toner that has been transferred from the blade 451 to the photoreceptor drum 43.

In the description of the embodiment, the hardware processor 7 determines the necessity of performing the cleaning mode based on the conditions of the coverage rate of an original, the absolute humidity inside the apparatus and the number of printing. Instead, the image forming apparatus 100 may include a detector such as an optical sensor that detects foreign matter such as toner on the surface of the photoreceptor drum 43, and the hardware processor 7 may determine the necessity of performing the cleaning mode or completion of the cleaning mode based on the detection result by the detector.

The described embodiment is an example in which a color image on the sheet M is formed by the image forming apparatus 100 that includes image forming units for individual colors such as Y (yellow), M (magenta), C (cyan) and K (black). However, it is only an example, and the embodiments also include image forming apparatuses that form a single color image.

While the described embodiment is an example in which the recording medium is a sheet, the recording medium is not limited to paper but may be any sheet on which a toner image can be formed and fixed such as non-woven, plastic film and leather.

This U.S. patent application claims priority to Japanese patent application No. 2016-019392 filed on Feb. 4, 2016, the entire contents of which are incorporated by reference herein for correction of incorrect translation.

What is claimed is:

1. An image forming apparatus, comprising:

a potential applier which applies a potential to an image carrier;

a cleaning device which comprises an abutting member abutting a surface of the image carrier and which removes residual toner on the surface of the image carrier by means of the abutting member after a toner image formed on the surface of the image carrier is transferred to a transfer material;

a hardware processor which, in a cleaning mode for removing a foreign matter attached to the abutting member of the cleaning device, controls the potential applier to alternately apply a first potential and a second potential which is lower than the first potential to the image carrier so as to periodically change a potential of the abutting member without causing saturation.

2. The image forming apparatus according to claim 1, further comprising:

a measuring device which measures a potential of the image carrier and the potential of the abutting member, wherein the hardware processor changes at least one of the first potential and the second potential of the image carrier based on a difference between the potential of the image carrier and the potential of the abutting member measured by the measuring device.

3. The image forming apparatus according to claim 1, further comprising:

a charger which charges the image carrier;

an exposure device which exposes the image carrier to form an electrostatic latent image;

a developer which develops the electrostatic latent image by attaching toner onto the surface of the image carrier so as to form a toner image; and a transfer device which transfers the toner image on the surface of the image carrier to the transfer material, wherein the potential applier is constituted by one of the charger, the exposure device and the transfer device or any combination thereof.

4. The image forming apparatus according to claim 1, further comprising:

an adjuster which adjusts a pressing force of the abutting member, wherein in the cleaning mode, the hardware processor controls the adjuster to reduce the pressing force of the abutting member against the image carrier to a lower level than the pressing force in a printing mode for forming an image.

5. The image forming apparatus according to claim 1, wherein in the cleaning mode, the hardware processor rotates the image carrier in a reverse direction so as to transfer the foreign matter from the abutting member to the image carrier, and then rotates the image carrier in a forward direction so as to remove the foreign matter by means of the cleaning device.

6. The image forming apparatus according to claim 1, wherein the hardware processor determines necessity of performing the cleaning mode based on any one of a coverage rate of an original, the number of printing and absolute humidity or any combination thereof.

7. The image forming apparatus according to claim 6, wherein the hardware processor determines a duration of performing the cleaning mode based on any one of the coverage rate of the original, the number of printing and the absolute humidity or any combination thereof.

8. The image forming apparatus according to claim 1, further comprising:

a detector which detects the foreign matter on the surface of the image carrier, wherein the hardware processor determines necessity of performing the cleaning mode based on a detection result by the detector.

9. The image forming apparatus according to claim 1, further comprising:

a detector which detects the foreign matter on the surface of the image carrier, wherein the hardware processor terminates the cleaning mode based on a detection result by the detector.

10. An image forming apparatus, comprising:

an image forming device which forms a toner image on a surface of an image carrier and which transfers the toner image to a transfer material;

a cleaning device which comprises an abutting member abutting the surface of the image carrier and which removes residual toner on the surface of the image carrier by means of the abutting member after the toner image formed on the surface of the image carrier is transferred to the transfer material;

a driver which drives the abutting member; and a hardware processor which, in a cleaning mode for removing a foreign matter attached to the abutting member of the cleaning device, controls the driver to alternately switch a status of the abutting member between abutment and separation with respect to the image carrier so as to periodically change a potential of the abutting member without causing saturation.

11. The image forming apparatus according to claim 10, wherein the abutting member of the cleaning device comprises a plurality of abutting members, and wherein the hardware processor controls the driver to switch a position of the plurality of abutting members so as to switch the plurality of abutting members.

12. The image forming apparatus according to claim 10, further comprising:

an adjuster which adjusts a pressing force of the abutting member, wherein in the cleaning mode, the hardware processor controls the adjuster to reduce the pressing force of the abutting member against the image carrier to a lower level than the pressing force in a printing mode for forming an image.

13. The image forming apparatus according to claim 10, wherein in the cleaning mode, the hardware processor rotates the image carrier in a reverse direction so as to transfer the foreign matter from the abutting member to the image carrier, and then rotates the image carrier in a forward direction so as to remove the foreign matter by means of the cleaning device.

14. The image forming apparatus according to claim 10, wherein the hardware processor determines necessity of performing the cleaning mode based on any one of a coverage rate of an original, the number of printing and absolute humidity or any combination thereof.

15. The image forming apparatus according to claim 14, wherein the hardware processor determines a duration of performing the cleaning mode based on any one of the coverage rate of the original, the number of printing and the absolute humidity or any combination thereof.

16. The image forming apparatus according to claim 10, further comprising:

a detector which detects the foreign matter on the surface of the image carrier, wherein the hardware processor determines necessity of performing the cleaning mode based on a detection result by the detector.

17. The image forming apparatus according to claim 10, further comprising:

a detector which detects the foreign matter on the surface of the image carrier, wherein the hardware processor terminates the cleaning mode based on a detection result by the detector.

18. A foreign matter removing method of an image forming apparatus which comprises:

a potential applier which applies a potential to an image carrier; and a cleaning device which comprises an abutting member abutting a surface of the image carrier and which removes residual toner on the surface of the image carrier by means of the abutting member after a toner image formed on the surface of the image carrier is transferred to a transfer material, the method comprising:

in a cleaning mode for removing a foreign matter attached to the abutting member of the cleaning device, controlling the potential applier to alternately apply a first potential and a second potential which is lower than the first potential to the image carrier so as to periodically change a potential of the abutting member without causing saturation.

19. A foreign matter removing method of an image forming apparatus which comprises:

an image forming device which forms a toner image on a surface of an image carrier and which transfers the toner image to a transfer material;

a cleaning device which comprises an abutting member abutting the surface of the image carrier and which removes residual toner on the surface of the image carrier by means of the abutting member after the toner image formed on the surface of the image carrier is transferred to the transfer material; and a driver which drives the abutting member, the method comprising:

in a cleaning mode for removing a foreign matter attached to the abutting member of the cleaning device, controlling the driver to alternately switch a status of the abutting member between abutment and separation with respect to the image carrier so as to periodically change a potential of the abutting member without causing saturation.

* * * * *